US007311095B2

(12) United States Patent
Bauder

(10) Patent No.: US 7,311,095 B2
(45) Date of Patent: Dec. 25, 2007

(54) VEHICLE MOUNTED BOW PRESS

(76) Inventor: Gary R. Bauder, 4501 Samara, NW., Albuquerque, NM (US) 87120

( * ) Notice: Subject to any disclaimer, the term of this patent is extended or adjusted under 35 U.S.C. 154(b) by 143 days.

(21) Appl. No.: 11/247,507

(22) Filed: Oct. 11, 2005

(65) Prior Publication Data

US 2007/0079818 A1 Apr. 12, 2007

(51) Int. Cl.
*F41B 5/14* (2006.01)

(52) U.S. Cl. ..... 124/1; 124/86

(58) Field of Classification Search ..... 124/23.1, 124/1, 80, 86

See application file for complete search history.

(56) References Cited

U.S. PATENT DOCUMENTS

| | | | | |
|---|---|---|---|---|
| 3,055,655 | A | 9/1962 | Chelf | |
| 4,077,385 | A | 3/1978 | Fredrickson | |
| 4,195,397 | A | 4/1980 | Saunders | |
| 4,599,987 | A | 7/1986 | Rezmer | |
| 4,908,925 | A | 3/1990 | Johnson | |
| 5,022,377 | A | 6/1991 | Stevens | |
| 5,115,795 | A | 5/1992 | Farris | |
| 5,125,389 | A | 6/1992 | Paff | |
| 5,220,906 | A | 6/1993 | Choma | |
| 5,222,473 | A | 6/1993 | Lint | |
| 5,370,103 | A | 12/1994 | Desselle | |
| 5,425,350 | A | 6/1995 | Egusquiza | |
| 5,433,186 | A | 7/1995 | Corwin | |
| 5,983,879 | A | 11/1999 | Gifford | |
| 6,220,235 | B1 | 4/2001 | Sands | |
| 6,386,190 | B1 | 5/2002 | Kurtz, Jr. | |
| 6,932,070 | B1 * | 8/2005 | Kurtz, Jr. | 124/1 |
| 6,968,834 | B1 * | 11/2005 | Gibbs | 124/1 |

* cited by examiner

*Primary Examiner*—John A. Ricci
(74) *Attorney, Agent, or Firm*—Dennis F. Armijo

(57) ABSTRACT

A portable bow press apparatus and method for compressing an archery compound bow for relieving the tension from the cables and/or the bowstring. The method and apparatus are used for replacement or maintenance purposes of the archery compound bow. The preferred apparatus is mounted to a vehicle receiver hitch for field use and is designed to accommodate all styles of compound bows. Compression is provided to the bow press by any type of standard vehicle jack. The bow press is compartmentalized for stowage purposes.

14 Claims, 5 Drawing Sheets

VARIATIONS

VEHICLE MOUNTED BOW PRESS

BACKGROUND OF THE INVENTION

1. Field of the Invention (Technical Field)

The present invention relates to bow stringing and more particularly to a portable bow press for the purpose of compressing a compound archery bow or archery bow of another type, in order to perform maintenance and/or repair to the bow.

2. Background Art

A bow press is required for compressing an archery compound bow, a recurve bow or a long bow for purposes of maintenance and repair. There has been a longstanding need for a portable press that is both safe and stable. This is especially true when a bow needs repair or adjustment in the field or campsite.

The available portable presses do not provide a stable platform or fixture which holds the bow in a more serviceable manner for purposes of repair and maintenance. Further, presses which provide the aforementioned holding fixture stability are designed for use on a floor or bench top. None of these are designed for or can be used in the field. Most of the prior art presses provide a mechanism for performing the compression, such as winches, turnbuckles or jacks to assist in providing the compression. All bow presses provide a method of engaging the limbs of the bow and pressing them in an opposite direction of the riser of the bow in order to release tension from the bow. The primary difference between the present invention and the prior art is that present invention attaches to a vehicle and utilizes the jack that comes with that vehicle to provide the compression. It also engages the "riser" portion of the bow at the handgrip which is the same on all bows, providing a simple application, whereas the prior art devices use a complex application by attempting to adjust for different riser styles. Another feature distinguishing the present invention is that it's design is of a simplicity such that custom parts or processes are not required for manufacture.

These prior art devices include U.S. Pat. No. 5,022,377 to Stevens. This device is a totally integral bow press. It does not mount to anything for stability and in fact discusses holding the entire unit including the bow in one hand while using the screw device with the other to compress the bow. Further, the screw device is integrated into the device. The Stevens device also uses a "thread stop" adjustment to accommodate the different sized bows. Stevens also requires a U shaped mechanism to provide the compression force to the bow grip. U.S. Pat. No. 5,222,473 to Lint uses a complex frame to pull the arms of the bow together. Similarly, U.S. Pat. No. 4,599,987 to Rezmer uses a string arrangement attached to the arms of a bow and a handle to pull the arm toward each other. U.S. Pat. No. 5,425,350 to Egusuiza also uses a similar device consisting of a turnbuckle and chain to pull the arm of a bow together. U.S. Pat. No. 5,433,186 to Corwin, U.S. Pat. No. 5,370,103, and U.S. Pat. No. 6,386,190 B1 to Kurtz, all use a complex four point compression method where the arms of the bow are held in position by rollers or pins and the pushing member consists of a pair of rollers at affixed distance from each other for pushing the central portion of the arms.

The present invention has several unique features that are not taught or implied by the prior art patents. The invention is stabilized by a receiver hitch. It uses a variety of jacks that are provided with every vehicle, to provide the compression force. The riser is adjustable to accommodate the different style jacks and bows. The invention also is modular using several off-the-shelf parts. The modularity of the invention allows for stowage, thus it can be used at home or in the field. None of the prior art devices disclose the unique features of the present invention.

SUMMARY OF THE INVENTION (DISCLOSURE OF THE INVENTION)

Disclosed is a portable bow press for the purpose of compressing a compound archery bow or archery bow of another type, in order to perform maintenance and/or repair to the bow. The preferred bow press comprises a horizontally situated rigid beam with a second rigid beam perpendicularly attached at the center. This second beam comprises the portion of the press to be inserted into a vehicle mounted receiver hitch. Also attached to the horizontal beam, opposite the hitch insert, is a housing, open on two sides, through which a third rigid beam can freely pass on a vertical axis perpendicular to the horizontal beam. Attached also to the horizontal beam, on the same side as the housing are two spindles, or the like, which can be positioned at multiple locations along the beam, to accommodate different sizes of archery bows. The vertical beam has at its base, a plate to accommodate a variety of vehicle jacks, and at the opposite end, a means of engaging the archery bow at its handgrip.

A portable bow press as described herein, which enables the user to relieve the tension from both the bowstring and cables of a compound archery bow, for purposes of maintenance or repair while in the field. The present invention attaches to a receiver hitch on a host vehicle, using a standard hitch pin. The press also utilizes the jack with which the host vehicle is equipped. Some of its components can be stored within its other components, making it portable and self-contained.

A primary advantage of the present invention is that the invention brings a stable platform type press into the field where archery equipment is used.

Another advantage of the present invention is that it utilizes a standard receiver hitch of any vehicle in order to gain that stability.

Yet another advantage is the manner in which the invention makes use of the jack with which the host vehicle is already equipped.

Another advantage is the simple design, which uses off-the-shelf readily available components while minimizing manufacturing processes.

Yet another advantage is that the length of the receiver insert is such that the bow being pressed can have attachments such as bow-quiver or bow-sights.

Another advantage is that the press engages the bow at the handgrip, negating the need to adjust to multiple bow styles.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

BEST MODES FOR CARRYING OUT THE INVENTION

Figure 1:
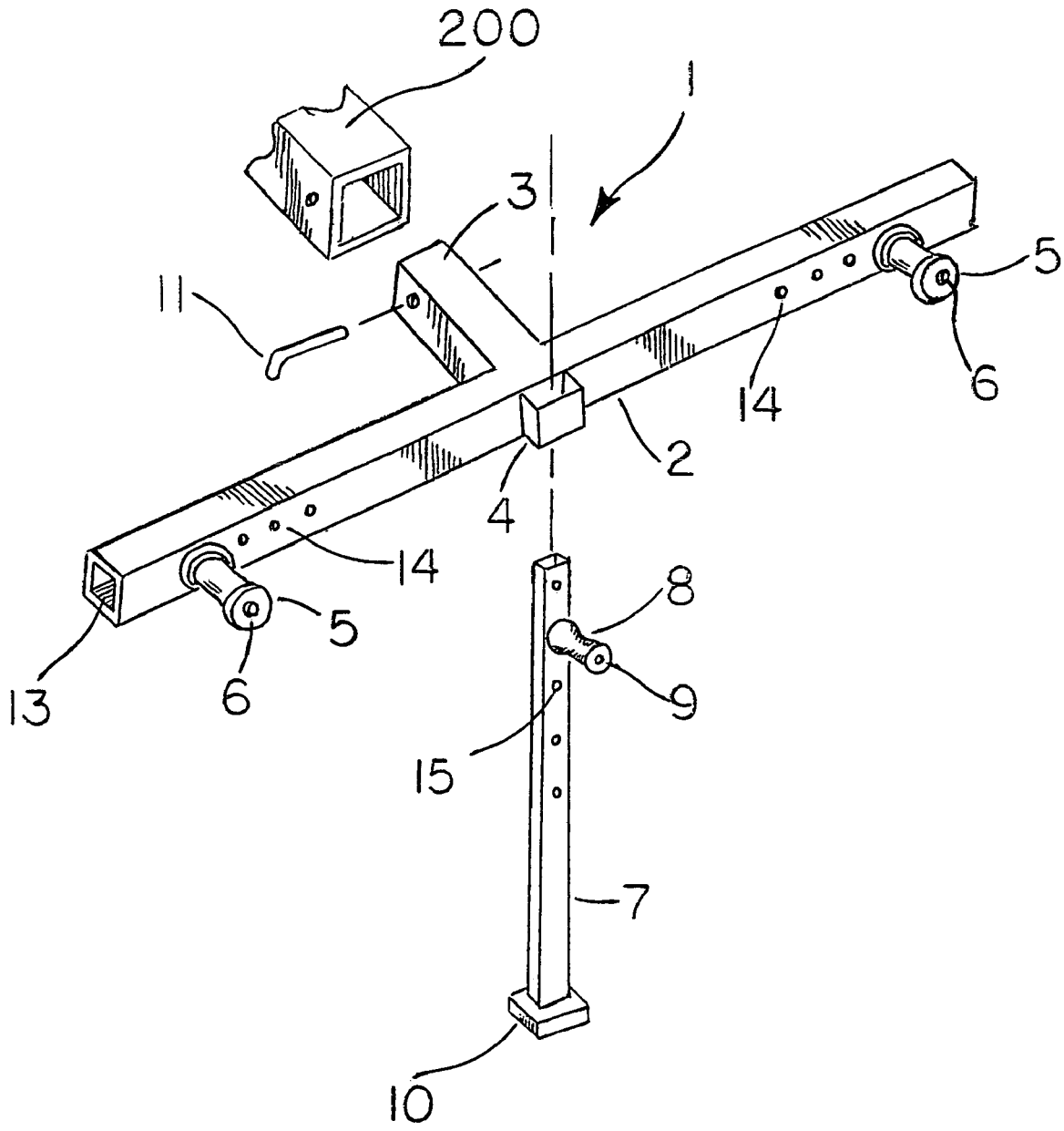
FIG. 1 shows the preferred embodiment of the invention.

Disclosed is a unique and simple bow press that can be used in the field. A bow press is used to maintain and repair bows. The present invention uses a typical method for a bow press. The arms of the bow are held in place at a predetermined distance from the ends and a compressing force is applied against the handle of the bow causing the ends of the bow to approach each other, thus relieving the tension of the cables or string. FIG. 1 shows the components that make up the preferred embodiment of the invention. The bow press comprises a 'T' shaped member 1 comprised of a first rigid straight beam 2, and a shorter second rigid straight beam attached perpendicular to first beam 2. This shorter second beam constitutes receiver hitch insert 3. Also attached to first beam 2 opposite receiver hitch insert 3 is a guide channel 4. The preferred bow press also comprises a vertical riser 7 with a base plate 10 attached to one end. Guide channel 4 allows vertical riser 7, to pass through, while keeping riser 7 perpendicular to beam 2. There are several evenly spaced arm apertures 14 at either end of first beam 2 to allow for arm roller spools 5 to be mounted using arm axles 6 comprised of bolts, lynch-pins, or the like. Although the figures show four evenly spaced arm apertures 14, the number can be varied to accommodate various bow sizes and configurations. Vertical riser 7 also has evenly spaced handle apertures 15 allowing for the mounting of handle roller spool 8 using handle axle 9 at various distances from base plate 10. A pre-punched beam such as a sign-post can be used for this beam thus eliminating a drilling or aperture making process.

To use the bow press, the user inserts vertical riser 7 into channel guide 4. The 'T' shaped member 1 is then attached to the vehicle by inserting hitch insert 3 into the receiver hitch 200 of the host vehicle, ensuring that base plate 10 is towards the ground. Hitch insert 3 is then secured to hitch 200 with a hitch pin 11. Arm roller spools 5 are then adjusted inboard or outboard as necessary to accommodate the bow to be compressed.

Figure 3:
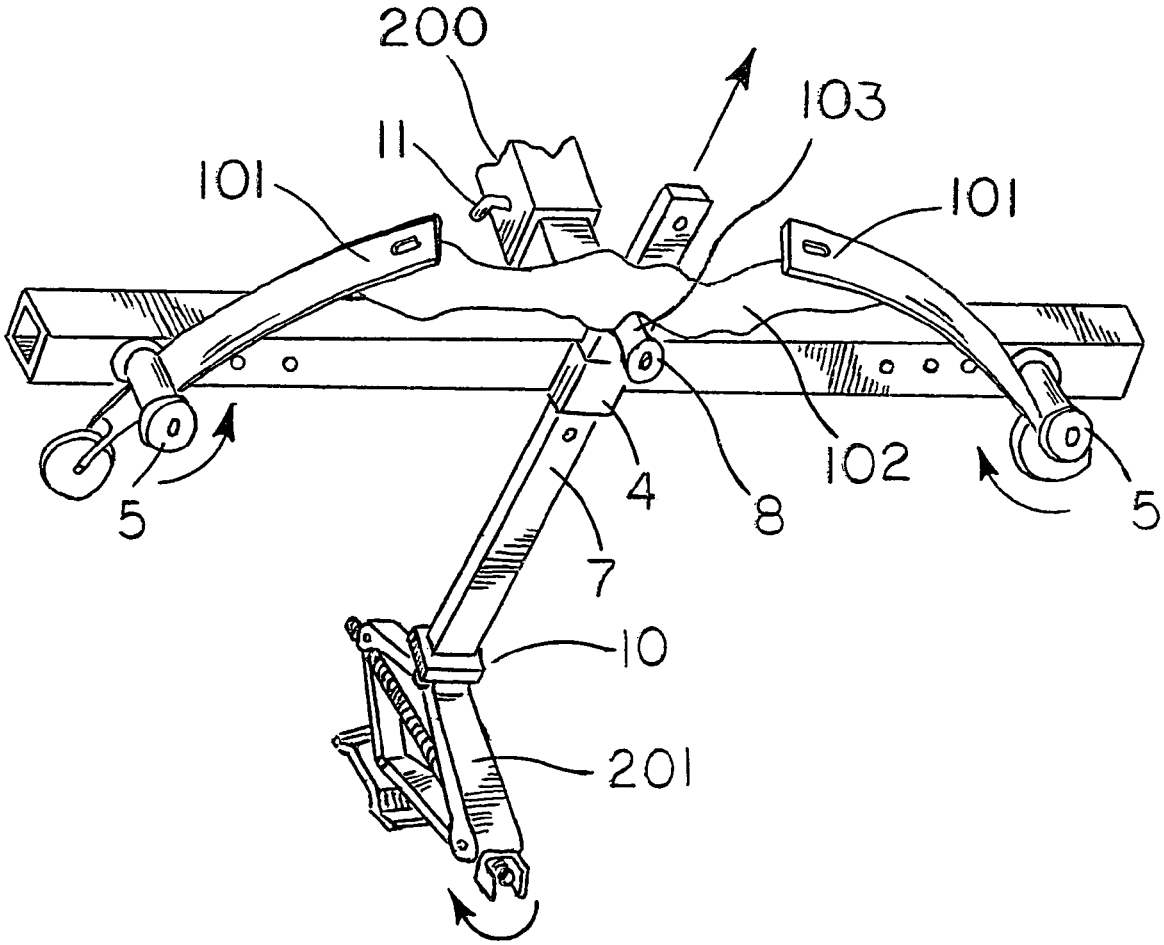
FIG. 3 shows a bow inserted into the preferred embodiment using a scissor jack to provide the compression.

FIG. 3 shows the preferred embodiment with a bow attached to the press and being compressed with a scissor jack. Vehicle jack 201 is placed in the compressed position between base plate 10 and the ground. The bow is positioned bowstring down with limbs or arms 101 beneath arm rollers 5. Handle roller 8 is installed onto vertical riser 7 beneath the rigid portion or handle 102 of the bow. As jack 201 is extended, handle roller 8 engages the bow at handgrip 103. The bow is lifted and compressed between arm rollers 5.

Figure 2:
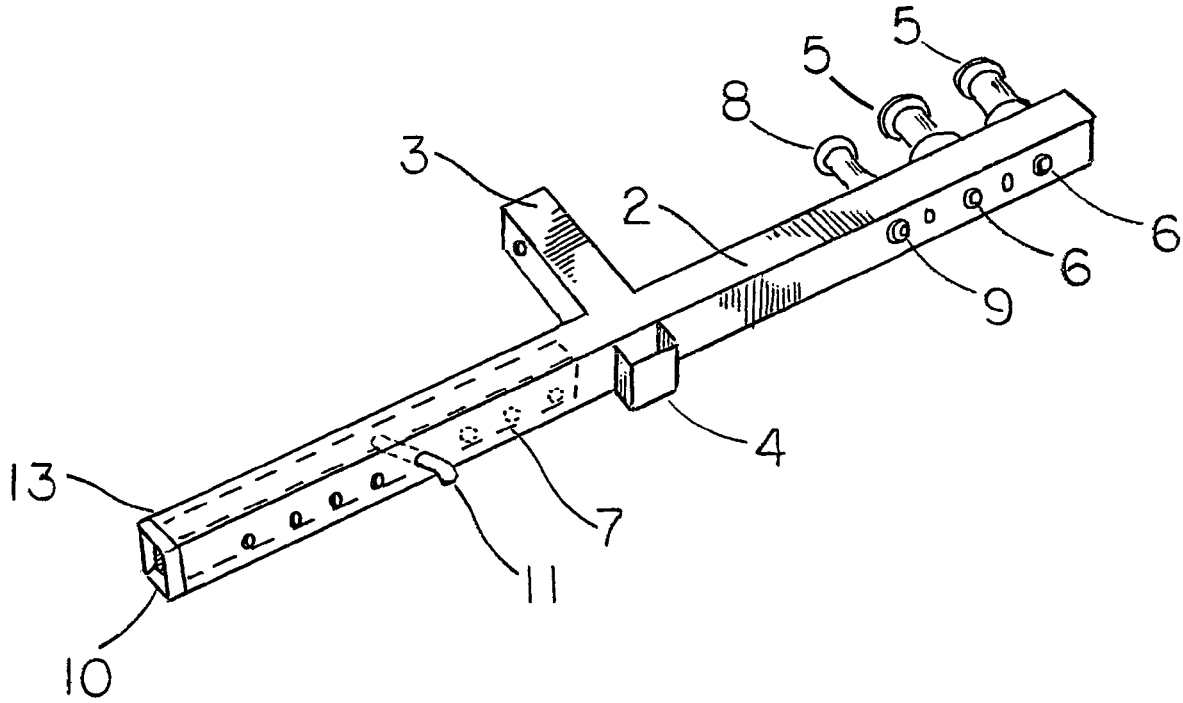
FIG. 2 shows the embodiment of FIG. 1 in a stowed state.

Another unique feature of the present invention is that the preferred bow press can be compartmentalized and stowed. FIG. 2 shows the preferred embodiment in the stowed configuration. Vertical riser 7 when removed from channel guide 4 can be inserted into first beam 2 at location 13. The arm and handle spool rollers 5 and 8 can be mounted at the opposite end of first beam 2, using arm and handle axles 6 and 9 for storage. When vertical riser 7 is stowed inside first beam 2, base plate 10 becomes an end cap for first beam 2. Vertical riser 7 is secured within first beam 2 by hitch pin 11. When arm and handle rollers 5 and 8 are mounted for storage, they are mounted on the same side of first beam 2 as hitch insert 3 to increase portability.

Figure 4:
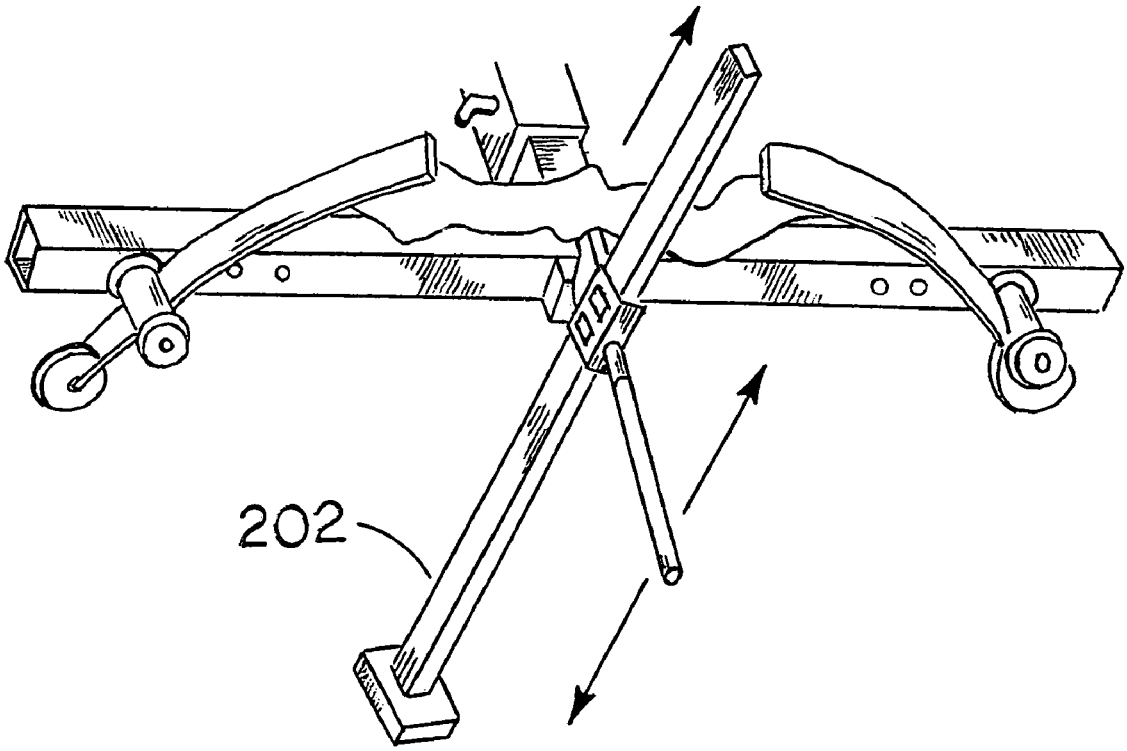
FIG. 4 shows a bow inserted into the preferred embodiment using a bumper jack to provide the compression.

The purpose for vertical riser 7 is to accommodate the use of many different vehicle jacks, such as scissor jacks, floor jacks, telescopic jacks or the many varieties of bumper jacks. FIG. 4 shows an alternative embodiment using a bumper jack. Some rail type jacks such as a farm jack or a straight bumper jack 202 negate the need for riser 7, and can be used to lift the bow directly by engaging the lift hook of the jack to the hand grip area 103 of the bow. A glove or rag placed between the jack and the bow will prevent marring of the bow (not shown).

Figure 5:
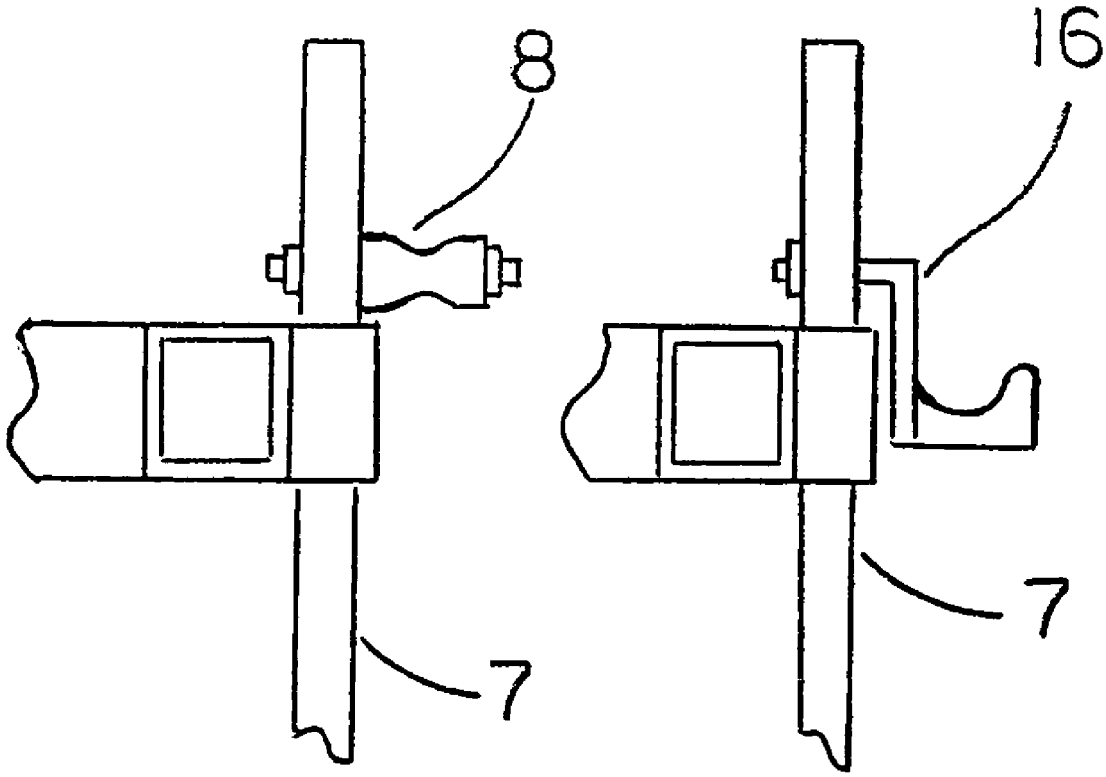
FIG. 5 shows the different embodiments for the hand grip engagement apparatus.

FIG. 5 shows two alternative types of handgrip engagement apparatuses. The portion of the press which engages handgrip area 103 of the bow is aligned with arm spool rollers 5 through a combination of vertical riser 7 thickness and length of handle spool roller 8. A cradle like apparatus or hook 16 can also be substituted for handle spool roller 8 placing the bow interface lower than handle spool roller 8 will allow.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. A portable apparatus for compressing a bow, the apparatus comprising:

a hitch insert for inserting into a receiver hitch;

a rigid beam affixed substantially perpendicular to said hitch insert;

two spindles attached to said rigid beam for holding arms of the bow;

a channel guide affixed to said rigid beam; and a vertical sliding riser for insertion into said channel guide, wherein said vertical sliding riser comprises a plurality of bow handle engaging position stops, said vertical sliding riser further comprising a bow handle engaging member on a first end and a base plate affixed to a second end for accepting a vehicle jack.

2. The portable apparatus of claim 1 wherein said rigid beam comprises a plurality of complimentary rigid beam apertures for removeably attaching said two spindles.

3. The portable apparatus of claim 1 wherein said channel guide is affixed substantially in a center of said rigid beam.

4. The portable apparatus of claim 1 wherein said plurality of bow handle engaging position stops comprises a plurality of riser apertures for removeably mounting said bow handle engaging member.

5. The portable apparatus of claim 1 wherein said bow handle engaging member comprises a member from the group consisting of a roller and a cradle.

6. The portable apparatus of claim 1 wherein the vehicle jack comprises a member from the group consisting of a scissor jack, a floor jack, a bumper jack, a rail jack and a telescopic jack.

7. The portable apparatus of claim 1 wherein said spindles comprise roller spools and arm axles.

8. The portable apparatus of claim 1 wherein said vertical riser comprises a pre-punched rigid post.

9. The portable apparatus of claim 1 wherein said hitch insert further comprises a hitch pin.

10. The portable apparatus of claim 1 wherein the portable apparatus is modular.

11. A method of compressing a bow with a portable bow compressing apparatus, the comprising the steps of:

a) inserting a hitch insert into a receiver hitch, the hitch insert affixed perpendicularly to a rigid beam;

b) sliding a vertical riser into a channel guide, the channel guide affixed to the rigid beam;

c) adjusting two spindles on the rigid beam to accept arms of the bow;

d) placing a jack under a base plate affixed to a first end the vertical riser; inserting a bow with the arms pressed against the spindles and a handle of the bow pressed against a handle engaging member affixed to a second end of the vertical riser; and e) raising the jack.

12. The method of claim 11 further comprising the step of lowering the jack to decompress the bow.

13. The method of claim 12 further comprising stowing the portable bow compressing.

14. The method of claim 13 wherein the step of stowing comprises inserting the vertical riser inside the rigid beam.

* * * * *